US005408068A

United States Patent [19]

Ng

[11] Patent Number: 5,408,068

[45] Date of Patent: Apr. 18, 1995

[54] ELECTRIC HEATER FOR USE IN VEHICLE

[76] Inventor: Wai-Man Ng, No. 14, 12th Floor, Favor Industrial Centre, 2-6 Kin Hong Street, Kwai Chung, New Territories, Hong Kong

[21] Appl. No.: 75,030

[22] Filed: Apr. 29, 1993

Related U.S. Application Data

[63] Continuation of Ser. No. 812,827, Dec. 24, 1991, abandoned.

[51] Int. Cl.[6] ..... H05B 3/34

[52] U.S. Cl. ..... 219/202; 219/521; 219/535

[58] Field of Search ..... 219/202, 521, 528, 535

[56] References Cited

U.S. PATENT DOCUMENTS

| | | | |
|---|---|---|---|
| 1,455,287 | 5/1923 | Hadley | 219/535 X |
| 1,992,593 | 2/1935 | Whitney | 219/535 X |
| 2,512,875 | 6/1950 | Reynolds . | |
| 2,617,916 | 11/1952 | Neidnig . | |
| 2,889,445 | 6/1959 | Wolf . | |
| 3,621,192 | 11/1971 | Pohler . | |
| 3,657,517 | 4/1972 | Hoyt | 219/535 |
| 4,061,898 | 12/1977 | Murray et al. . | |
| 4,065,660 | 12/1977 | Berard | 219/535 |
| 4,119,836 | 10/1978 | Motokawa . | |
| 4,833,299 | 5/1989 | Estes | 219/535 X |

FOREIGN PATENT DOCUMENTS

| | | | |
|---|---|---|---|
| 1506821 | 11/1967 | France | 219/535 |
| 2421529 | 11/1979 | France | 219/202 |
| 279883 | 4/1952 | Switzerland | 219/521 |
| 765709 | 1/1957 | United Kingdom | 219/528 |

*Primary Examiner*—Teresa J. Walberg

*Attorney, Agent, or Firm*—Burns, Doane, Swecker & Mathis

[57] ABSTRACT

An electric heater for use in a vehicle, to heat a container of food or beverage, includes a flexible jacket that is wrapped around the container to be heated, and an electrical lead and plug for connecting the heater to a source of electrical power, such as the cigarette lighter socket of a vehicle. The flexible jacket consists of inner and outer cover layers. Sandwiched between the inner and outer layers are a flexible layer of electrically conductive material, a flexible electric heating element secured to the layer of electrically conductive material, and a flexible insulating layer disposed between the layer of electrically conductive material and the outer cover layer. The electrical heating element is connected to the electrical lead, to receive power supplied thereby.

6 Claims, 3 Drawing Sheets

ELECTRIC HEATER FOR USE IN VEHICLE

This is a continuation of Ser. No. 07/812,827, filed Dec. 24, 1991, now abandoned.

FIELD OF THE INVENTION

The present invention relates to electric heaters for use in vehicles for heating containers of food or beverages.

SUMMARY OF THE INVENTION

The present invention provides an electric heater for use in a vehicle, to heat a container of food or beverage. The heater includes a flexible jacket that is wrapped around the container to be heated, and an electrical lead and plug for connecting the heater to a source of electrical power, such as the cigarette lighter socket of a vehicle. The flexible jacket consists of inner and outer cover layers. Sandwiched between the inner and outer layers are a flexible layer of electrically conductive material, a flexible electric heating element secured to the layer of electrically conductive material, and a flexible insulating layer disposed between the layer of electrically conductive material and the outer cover layer. The electrical heating element is connected to the electrical lead, to receive power supplied thereby.

The electric heater according to the invention allows a wide range of different containers to be heated while travelling, for example a baby's bottle or a sealed can of food.

Figure 1:
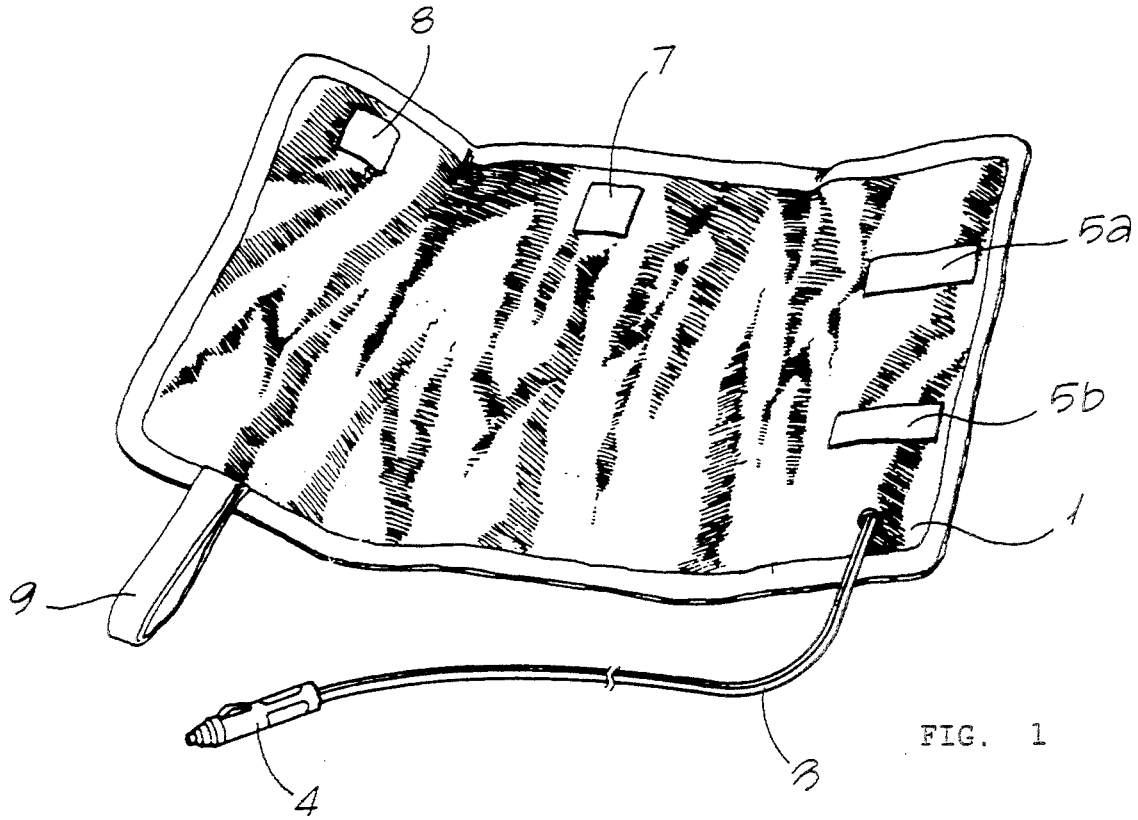
FIG. 1 is a perspective view of the electric heater showing the inside surface of the jacket, that is to say the surface which contacts the container.
Figure 2:
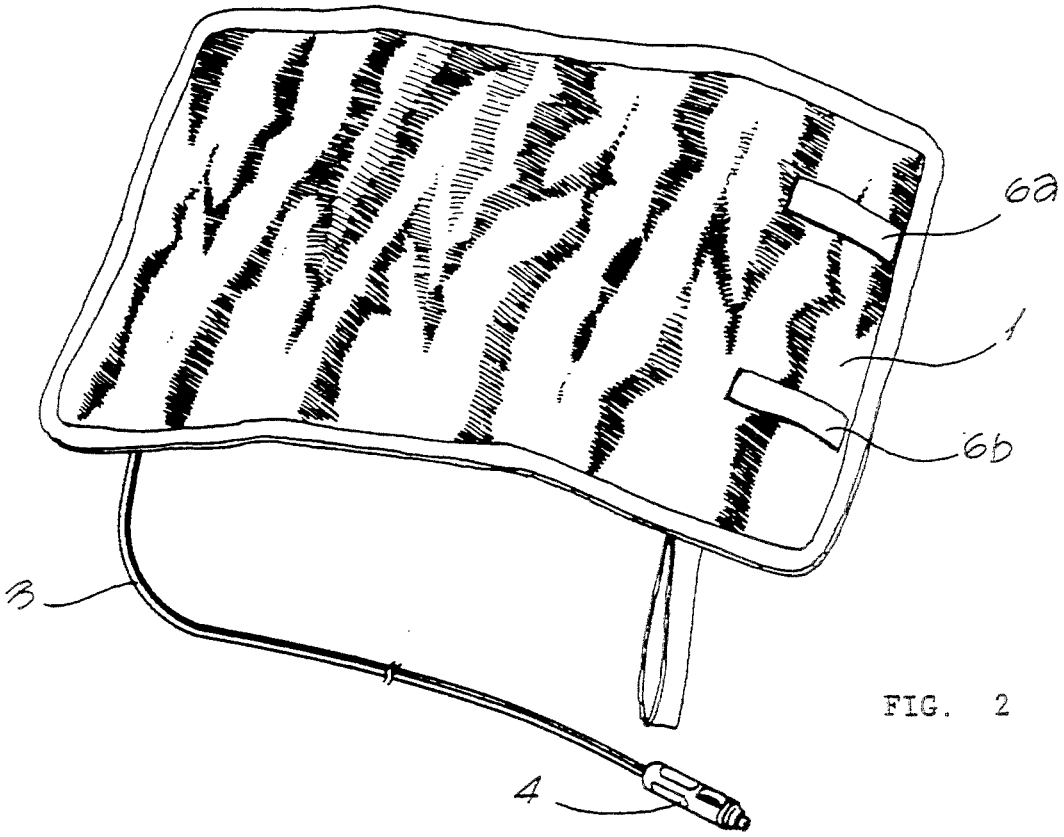
FIG. 2 is an alternative perspective view, showing the outside of the jacket.

Referring to the drawings, the electric heater comprises a flexible fabric jacket 1, a flexible electric heating element 2 (shown in FIGS. 4 and 5) whose outer surface is provided with suitable electrical insulation, an electric lead 3 and a plug 4 for connecting the electric heating element to the cigarette lighter socket of a vehicle, self-adhesive tabs 5*a*, 5*b* on the inside surface of the jacket and 6*a*, 6*b* on the outside surface of the jacket which co-operate in closing the jacket, self-adhesive tabs 7 and 8 for holding the closed jacket in a flattened configuration when not in use, and a hanging loop 9 to allow the electric healer and a container being heated to be hung from a hook in the interior of the vehicle.

Figure 3:
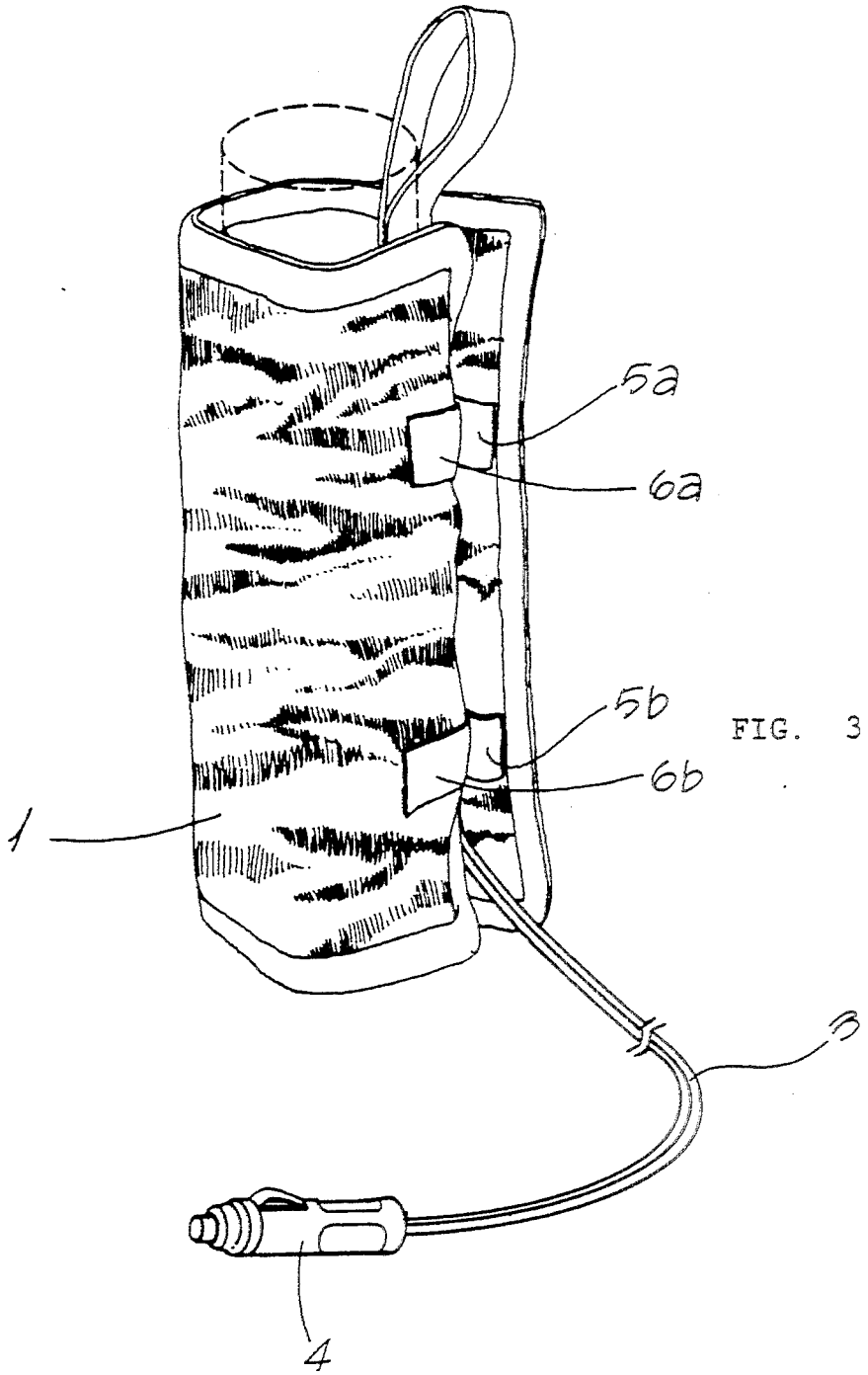
FIG. 3 is a perspective view of the electric heater in use in heating a baby's bottle.

In use, as best seen in FIG. 3, the jacket 1 is wrapped around a container, in this case a baby's bottle indicated by dashed lines, and is closed, the jacket 1 and container are then hung by means of the loop 9 from a hook in the vehicle, and the plug 4 is inserted into the cigarette lighter socket of the vehicle. The electric heating element 2 causes the inside surface of the jacket 1 to be heated, and this heat is transmitted to the container, thereby warming the contents of the container.

Figure 4:
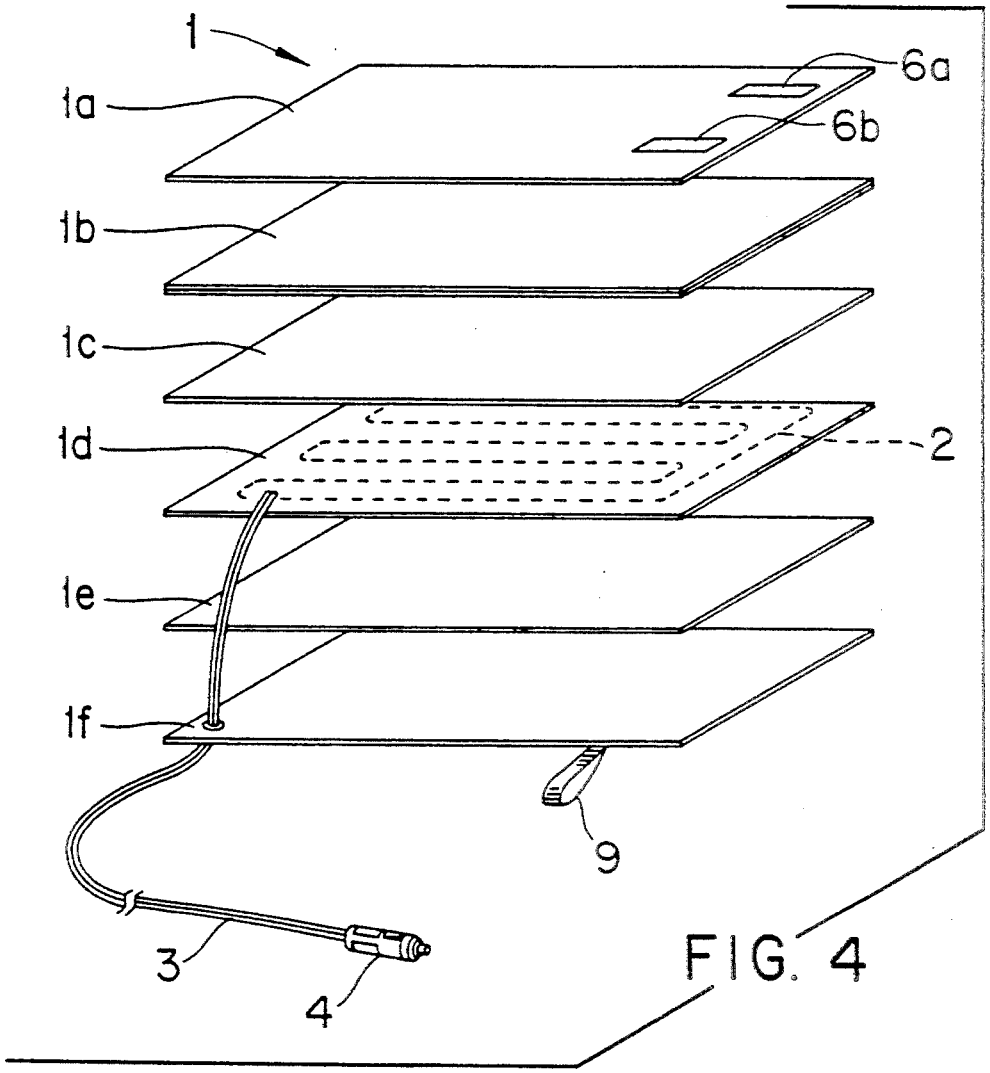
FIG. 4 is an exploded perspective view of the electric heater.
Figure 5:
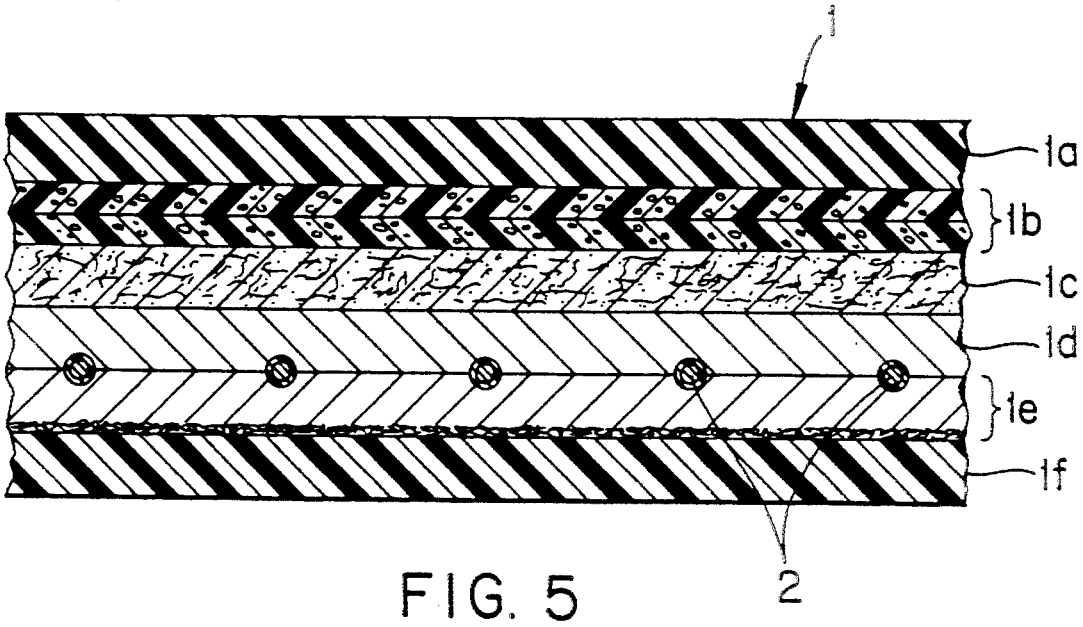
FIG. 5 is a cross-sectional view through the flexible jacket.

Referring now to FIGS. 4 and 5 the jacket 1 comprises an outer layer 1*a* of nylon, two layers 1*b* of sponge, a cotton layer 1*c* which is dark in color to contain heat, an aluminum sheet 1*d*, the electric heating element 2 which is sewn onto the inside face of the aluminium sheet 1*d* (shown in broken lines in the drawing), a further aluminum sheet with polyester yarn backing 1*e*, and an inside layer 1*f* of nylon. The sponge layer 1*b* traps a layer of air and thus acts as a heat insulator preventing escape of heat. The cotton layer 1*c* contains heat from the electric heating element 2 again preventing escape of heat. The combined effect of the sponge layer 1*b* and cotton layer 1*c* is to ensure that the heat travels to the inside surface of the jacket 1 to heat a container while leaving the outside surface of the layer at a sufficiently low temperature that it can be safely and comfortably handled. The polyester yarn backing serves to protect the aluminum sheet 1*e* by preventing it from being folded into sharp creases and then cracking.

I claim:

1. An electric heater for use in a vehicle to heat a container of food or beverage, comprimising:

a flexible jacket to be wrapped around a container to be heated, said jacket including a flexible inside layer for contact with a container to be heated;

a flexible outside layer, a flexible layer of electrically conductive material located between said inside and outside layers, a flexible electric heating element secured to said flexible layer of electrically conductive material; and a flexible thermal insulating layer disposed between said layer of electrically conductive material and said outside layer; and an electrical lead and plug connected to said heating element, for connecting said electric heating element to the cigarette lighter socket of a vehicle.

2. The electric heater of claim 1 wherein said layer of electrically conductive material includes an aluminum sheet.

3. The electric heater of claim 1 wherein said layer of electrically conductive material comprises plural sheets of a metallic material, at least one of said sheets having a polyester yarn backing to prevent cracking thereof.

4. The electric heater of claim 3 wherein said metallic material is aluminum.

5. The electric heater of claim 1 further including a flexible layer of heat containment material disposed between said insulating layer and said layer of electrically conductive material.

6. The electric heater of claim 3 wherein said flexible electric heating element is located between said plural sheets of metallic material.

* * * * *